United States Patent [19]

Tokuno et al.

[11] Patent Number: 4,658,723

[45] Date of Patent: Apr. 21, 1987

[54] COLOR PRINTING MACHINE

[75] Inventors: Masateru Tokuno, Hyogo; Tetsuya Sawada, Kyogo; Yasuharu Mori, Hyogo, all of Japan

[73] Assignee: Rengo Co., Ltd., Fukushima, Japan

[21] Appl. No.: 829,859

[22] Filed: Feb. 18, 1986

Related U.S. Application Data

[63] Continuation of Ser. No. 639,109, Aug. 9, 1984, abandoned.

[30] Foreign Application Priority Data

Aug. 18, 1983 [JP] Japan ..... 58-151404

[51] Int. Cl.[4] ..... B41F 5/06; B41F 5/16

[52] U.S. Cl. ..... 101/181; 101/228

[58] Field of Search ..... 101/118, 180, 181, 219, 101/221, 225, 228; 226/143

[56] References Cited

U.S. PATENT DOCUMENTS

| | | | |
|---|---|---|---|
| Re. 10,330 | 5/1883 | Hinds | 101/181 |
| 1,939,717 | 12/1933 | Morse | 226/143 X |
| 2,039,236 | 4/1936 | Meisel | 276/143 X |
| 2,521,691 | 9/1950 | Corlett | 101/228 X |
| 3,049,078 | 8/1962 | Smith, Jr. | 101/228 |
| 3,081,700 | 3/1963 | Kieckhefer, Jr. | 101/248 X |
| 3,756,149 | 9/1973 | Bishop | 101/228 |

FOREIGN PATENT DOCUMENTS

| | | | |
|---|---|---|---|
| 2909358 | 9/1979 | Fed. Rep. of Germany | 101/228 |
| 118892 | 9/1981 | Japan | 101/228 |
| 70665 | 5/1982 | Japan | 101/228 |

*Primary Examiner*—Charles A. Pearson

*Attorney, Agent, or Firm*—Wenderoth, Lind & Ponack

[57] ABSTRACT

A color printing machine having a plurality of printing units includes a plate cylinder and an impression cylinder. A web length adjusting unit is arranged between each pair of adjacent printing units so as to adjust the length of web existing between the printing units to be equal to the printing length multiplied by an integer.

1 Claim, 7 Drawing Figures

COLOR PRINTING MACHINE

This application is a continuation of now abandoned application Ser. No. 639,109, filed Aug. 9, 1984.

BACKGROUND OF THE INVENTION

The present invention relates to improvements in color printing machines used to color print a running web of paper, and particularly to a color printing machine having a plurality of printing units each including a plate cylinder and an impression cylinder, and a web length adjusting unit located between each pair of adjacent printing units.

FIG. 1 shows a conventional color printing machine which has an impression cylinder 1 and plate cylinders 2 (as many as the printing colors) mounted in contact with the periphery of the impression cylinder. As the web 4 to be printed passes between the impression cylinder 1 and the plate cylinders 2, it is printed by plates 3 mounted on the plate cylinders so as to enclose their whole periphery. The impression cylinder and the plate cylinders are driven from a single motor through a geared transmission for synchronized printing. Since the diameter of the plate cylinders is determined by the printing length which is the length of the plate, each time the printing length changes, new plate cylinders having a peripheral length corresponding to the new printing length have to be manufactured. This increases the printing cost. Furthermore, each time the printing length changes, heavy plate cylinders have to be replaced with new ones. New plate cylinders with new plates mounted thereon have to be mounted on the impression cylinder with a suitable contact pressure. This is a very troublesome work. Furthermore, fine adjustment of the transmission gear was necessary for phase tuning between the plate cylinders for accurate registration. Another disadvantage is that a lot of plate cylinders have to be maintained.

SUMMARY OF THE INVENTION

An object of the present invention is to provide a color printing machine which obviates the necessity of preparing different plate cylinders for different printing lengths.

Another object of the present invention is to provide a color printing machine which obviates the necessity of fine adjustment of the transmission gear for phase tuning between the plate cylinders.

In accordance with the present invention, the color printing machine has a plurality of printing units each having a plate cylinder and an impression cylinder. The plate cylinders of all the units are driven from a single motor. Each plate cylinder has a circumference longer than or equal to the maximum printing length. A web length adjusting unit is provided between each pair of the adjacent printing units to adjust the length of the web existing between the adjacent printing units to the printing length multiplied by an integer.

Since a plurality of printing units each having a plate cylinder and an impression cylinder are provided and each plate cylinder has a circumference longer than or equal to the maximum printing length, plate cylinders do not have to be prepared each time the printing length changes. Replacement of the plate cylinders and readjustment of relative phase between the plate cylinders are no longer needed.

On the other hand, such an arrangement of the printing units requires that the length of the web existing between the adjacent printing units be the printing length multiplied by an integer. Otherwise, registration between the printing units would get confused. This will be best understood from FIG. 2 in which the length of web existing between the adjacent printing units is the printing length multiplied by three, for example. This assures that different color inks will be put on the web with precise registration. At the first printing unit, the web is printed with e.g. red ink; at the second printing unit, it is printed with e.g. blue ink at precise positions; at the third printing unit, it is printed with e.g. yellow ink again at precise positions.

A major feature of the present invention is that a web length adjusting means is provided between the adjacent printing units to ensure that the length of the web existing between the adjacent printing units is the printing length multiplied by an integer.

BRIEF DESCRIPTION OF THE DRAWINGS

Other objects and features of the present invention will become apparent from the following description taken with reference to the accompanying drawings, in which.

DESCRIPTION OF THE PREFERRED EMBODIMENT

Figure 3:
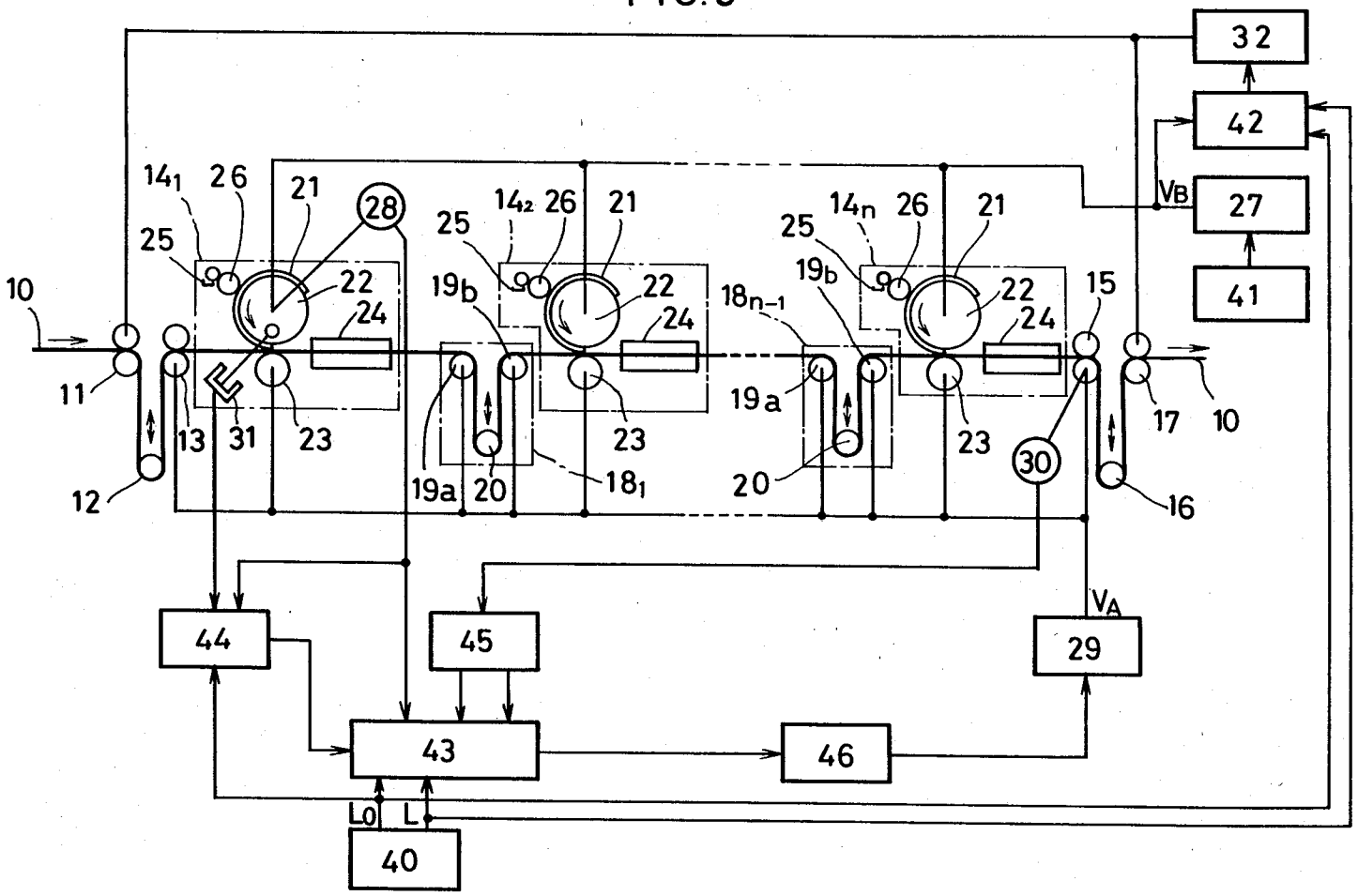
FIG. 3 is a block diagram of a multicolor printer embodying the present invention.

Referring to FIG. 3, a web 10 passes between a pair of first feed rolls 11, around a first accumulator roll 12, between a pair of second feed rolls 13, through printing units $\mathbf{14}_1$, $\mathbf{14}_2$, . . . $\mathbf{14}_n$, between a pair of first pull rolls 15, around a second accumulator roll 16 and between a pair of second pull rolls 17, and is fed to the next station.

Between the adjacent printing units there are web length adjusting units $\mathbf{18}_1$, $\mathbf{18}_2$, . . . $\mathbf{18}_{n-1}$ for adjusting the length of web existing between the adjacent printing units to the printing length (that is, the length of a printing plate) multiplied by an integer. Each web length adjusting unit comprises two paper rolls 19*a* and 19*b* and a vertically movable adjuster roll 20 disposed between these two paper rolls. By adjusting the height or vertical position of the adjuster roll 20, the length of web existing between the adjacent printing units is adjusted to the printing length multiplied by an integer. The first and second accumulator rolls are adapted to move up and down to adjust the web tension.

Each printing unit $\mathbf{14}_n$ comprises a plate cylinder 22 having a circumference which is greater than the printing length and adapted to carry a plate 21, an impression cylinder 23 adapted to press the web 10 and the plate 21 against the plate cylinder 22, a drier 24 for drying the ink applied to the surface of the web, and an ink roll 26 for applying ink from an ink reservoir 25 to the plate 21 on the plate cylinder 22. After being printed by the plates 21, the web 10 is dried by the driers 24 and discharged from the printing station.

The plate cylinders 22 in the printing units $14_1$–$14_n$ are coupled to a motor 27 through a transmission (not shown) having gears, sprockets and/or chains for synchronized driving. The amount of revolution of the plate cylinders 22 is detected by means of a first pulse generator 28 connected to one plate cylinder 22 (the plate cylinder of the first printing unit $14_1$ in the embodiment of FIG. 3) or any interlocking part.

The second feed rolls 13, the first pull rolls 15, the paper rolls 19*a*, 19*b* in all the web length adjusting units $18_1$–$18_{n-1}$, and the impression cylinders 23 in all the printing units $14_1$–$14_n$ are coupled to a control motor 29 through a transmission (not shown) having gears, sprockets and/or chains so that all of them will turn at the same peripheral speed. A second pulse generator 30 is connected to one of these rolls or cylinders (to the first pull roll 15 in the embodiment of FIG. 3) to detect the length for which the web 10 has run.

A print start detector 31 is provided adjacent to the plate cylinder 22 of one of the printing units $14_1$–$14_n$ in order to detect the start of printing. The first feed rolls 11 and the second pull rolls 17 are driven synchronously by a web driving motor 32.

On a setter 40, the peripheral length L of the plate cylinder 22 and the printing length Lo (that is usually the length of the plate 21) can be set. Since the value L is fixed after the size of the plate cylinder 22 has been determined, only the printing length Lo may be settable.

Figure 1:
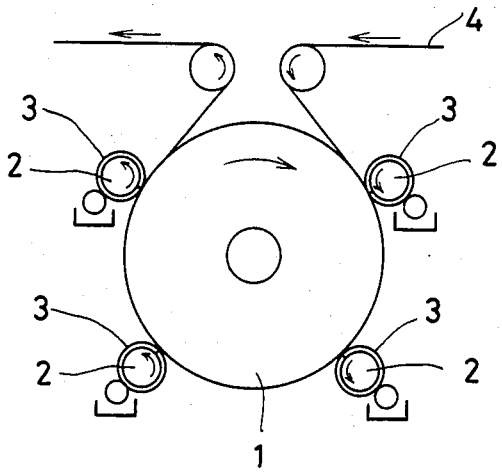
FIG. 1 is a schematic view of a prior art color printing machine.
Figure 2:
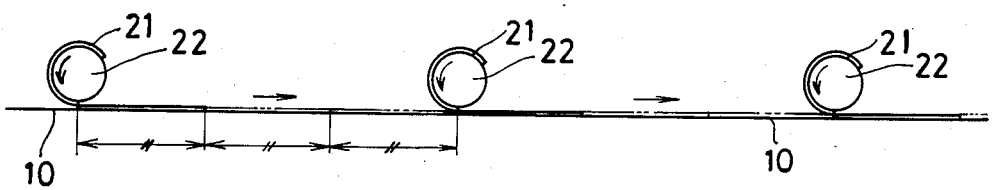
FIG. 2 is a schematic view showing why the length of web between the printing units has to be adjusted to the printing length multiplied by an integer.
Figure 4:
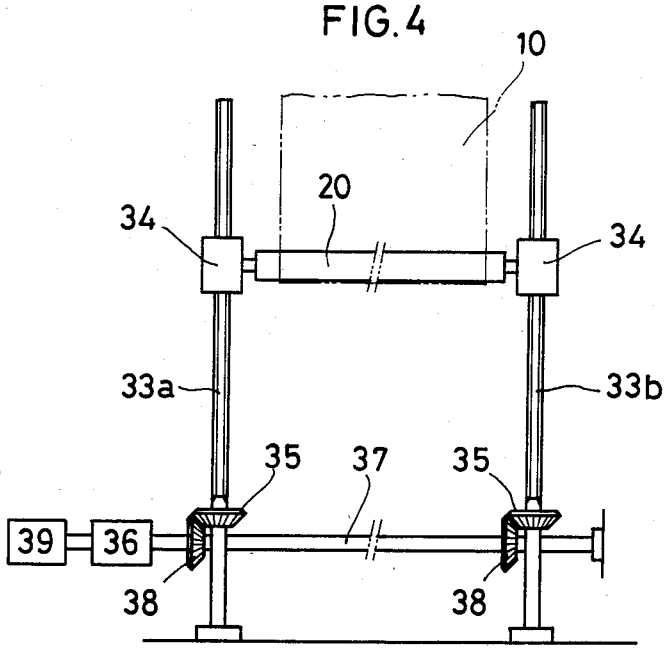
FIG. 4 is an enlarged view of the web length adjusting device used in the present invention.

Referring to FIG. 4, the web length adjusting unit comprise two threaded bars 33*a*, 33*b* rotatably supported on the floor, nuts 34 threadedly mounted on the threaded bars so as to move up and down as these bars turn, bevel gears 35 mounted on the threaded bars 33*a*, 33*b* at bottom thereof, a rotary shaft 37 driven by a web length adjusting motor 36, and bevel gears 38 mounted on the rotary shaft 37 so as to threadedly engage the respective bevel gears 35. When the motor 36 is actuated, the adjuster roll 20 is moved up or down so that the length of the web existing between the adjacent printing units will be adjusted. The motor 36 is provided with a pulse generator 39 which generates pulses as the rotary shaft 37 rotates.

Figure 5:
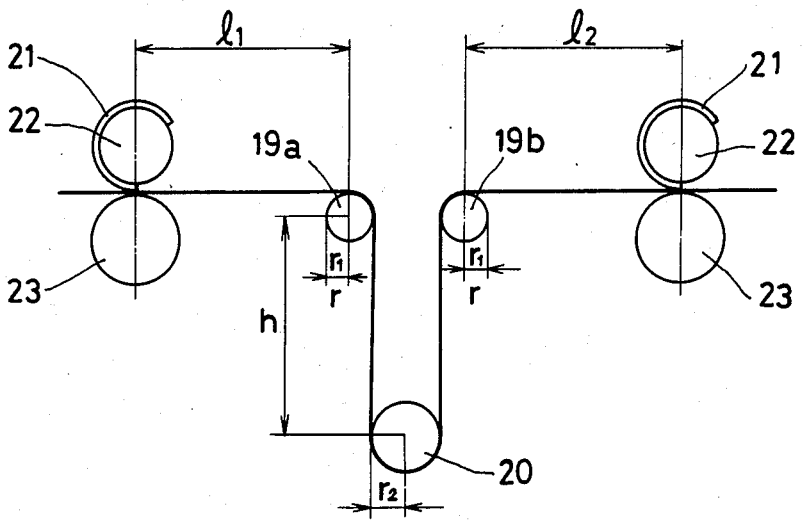
FIG. 5 is a view for explaining how the web length between the printing units is adjusted in accordance with the present invention.

In FIG. 5, the length l of the web existing between the adjacent printing units can be expressed as follows:

$$l = l_1 + l_2 + 2h + \pi(r_1 + r_2) \quad (1)$$

wherein

- $l_1$: Distance between the printing point upstream and the paper roll 19*a* upstream
- $l_2$: Distance between the printing point downstream and the paper roll 19*b* downstream
- h: Height from the adjuster roll 20 to the paper rolls 19*a*, 19*b*
- $r_1$: Radius of the paper rolls 19*a*, 19*b*
- $r_2$: Radius of the adjuster roll 20

From the equation (1), the height h can be expressed as follows:

$$h = \tfrac{1}{2}\{l - (l_1 + l_2) - \pi(r_1 + r_2)\} \quad (2)$$

The height of the adjuster roll 20 can be adjusted as follows: firstly, the web length l is set to a value which is the printing length Lo multiplied by an integer. The height h is then calculated by substituting the value l in the equation (2). The adjuster roll may be adjusted to the height thus determined, manually or automatically.

The operation of the color printing machine with web length adjusting means embodying the present invention will be described below, though the specific manner of control described is a mere example.

Firstly, the peripheral length L of the plate cylinder 22 and the printing length Lo are set in the setter 40. The adjuster rolls 20 in the web length adjusting units $18_1$–$18_{n-1}$ are adjusted to adjust the length of the web existing between the adjacent units of the printing units 14*a*–$14_n$ to the printing length multiplied by an integer in the abovementioned manner. A plate 21 is then set on the plate cylinder 22 in each printing unit, and ink of a required color is placed in the ink reservoir 25 in each printing unit.

The speed for the motor 27 for the plate cylinder 22 is set on the speed setter 41. A machine switch is turned on to start printing. The motor 27 is driven at the speed preset on the speed setter 41 so that the plate cylinder 22 will turn at the preset peripheral speed $V_B$ (which is, strictly speaking, the peripheral speed of the plate 21. But it will be referred to as the peripheral speed of the plate cylinder for simplicity). The web driving motor 32 is driven at a speed controlled by the arithmetic unit 42 so that the web will be fed at a speed $Lo/L \times V_B$ until it enters the first feed rolls 11 and after it has left the second pull rolls 17.

As described before, the web speed has to be controlled in a specific manner since each plate cylinder has a longer circumference than the maximum printing length. It will be described below how it is controlled in the preferred embodiment.

Figure 6:
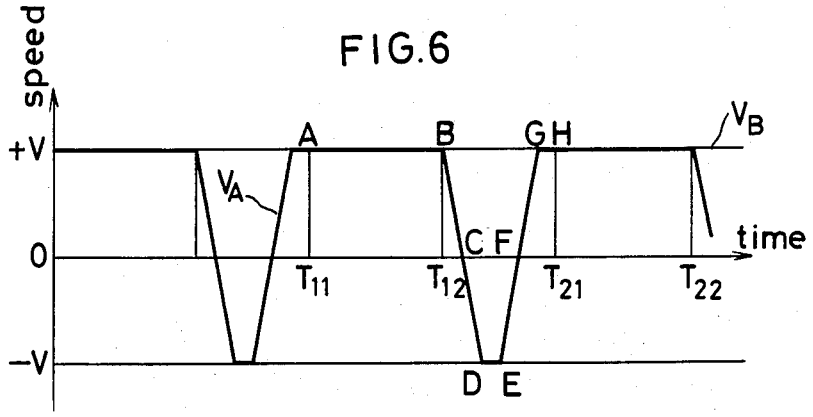
FIG. 6 is a graph showing how the web speed is controlled.

The control motor 29 is controlled by the first motor signal from the arithmetic sequence unit 43 as shown in FIG. 6. Thus, for the web existing between the second feed rolls 13 and the first pull rolls 15, the web speed is controlled to be substantially equal to the peripheral speed $V_B$ of the plate cylinder 22 from the print start point $T_{11}$ to the print end point $T_{12}$. During the period, the web is fed for the same distance as the printing length $L_O$. From the print end point $T_{12}$ to the next print start point $T_{21}$, the web is decelerated to zero speed, backed and then again advanced. Then, before the web arrives the next print start point $T_{21}$, the web speed is brought into accord with the peripheral speed $V_B$ of the plate cylinder 22.

During the time from the print start point $T_{11}$ to the print end point $T_{12}$, the web is printed by the printing units $14_1$–$14_n$. From the print end point $T_{12}$ to the next print start point $T_{21}$, the web is advanced, backed and advanced in a controlled manner so that at the next print start point $T_{21}$ the next position to be printed on the web will be in register with the plate 21. By repeating such controls, the web has been color printed without blank spaces when it leaves the second pull rolls 17.

Upon receipt of the print start signal from the print start detector 31, a preset counter 44 will read the printing length Lo and start the counting of the pulse signal from the first pulse generator 28. (FIG. 3). When its count becomes equal to the printing length Lo, the preset counter 44 will generate a print end signal to show that the printing with the plate 21 is complete.

A pulse discriminator 45 receives the pulse signal from the second pulse generator 30, and determines whether the generator 30 is turning in a normal or reverse direction (that is, whether the web is advancing or backing), and gives a positive or negative pulse signal accordingly.

An arithmetic sequence unit 43 receives the peripheral length L and the printing length Lo from the setter 40, the print end signal from the preset counter 44, the first pulse signal from the first pulse generator 28, and a positive or negative pulse signal from the pulse discriminator 45 and gives a first motor signal to control the control motor 29.

The first motor signal controls the control motor 29 through a driving unit 46. As shown in FIG. 6, at latest from the print start point $T_{11}$ to the print end point $T_{12}$, the web speed $V_A$ is controlled to be equal to the peripheral speed $V_B$ of the plate cylinder 22; during the period from the print end point $T_{12}$ to the next print start point $T_{21}$, the web is decelerated until it stops, backed, and then advanced again, as will be described below in more detail. The control motor 29 is controlled so that at latest before the next print start point $T_{21}$ comes, the web speed $V_A$ will again become equal to the peripheral speed $V_B$ of the plate cylinder 22 and so that at the next print start point $T_{21}$ the web 10 will come back to the position where the web was at the end of the last printing. In other words, the amount of forward movement from $T_{12}$ to $T_{21}$ is zero.

Thus, the first motor signal is such that in FIG. 6, the area of the rectangle $AT_{11}T_{12}B$ respresenting the length for which the web has moved during the printing will be equal to the preset printing length Lo. Also, the first motor signal controls the web speed as follows during the period from the print end point $T_{12}$ to the next print start point $T_{21}$; the web is decelerated from the point $T_{12}$ until its speed $V_A$ becomes zero at point C, is then moved backward and accelerated until its speed reaches a constant speed $-V$ (negative because the direction is backward) at point D, decelerated from point E until its speed becomes zero at point F, and is again advanced and accelerated until its speed again becomes equal to the peripheral speed $V_B$ of the plate cylinder 22 at point G which is this side of the print start point $T_{21}$. The web will maintain the speed until point H, that is, the next print start point $T_{21}$.

Figure 7:
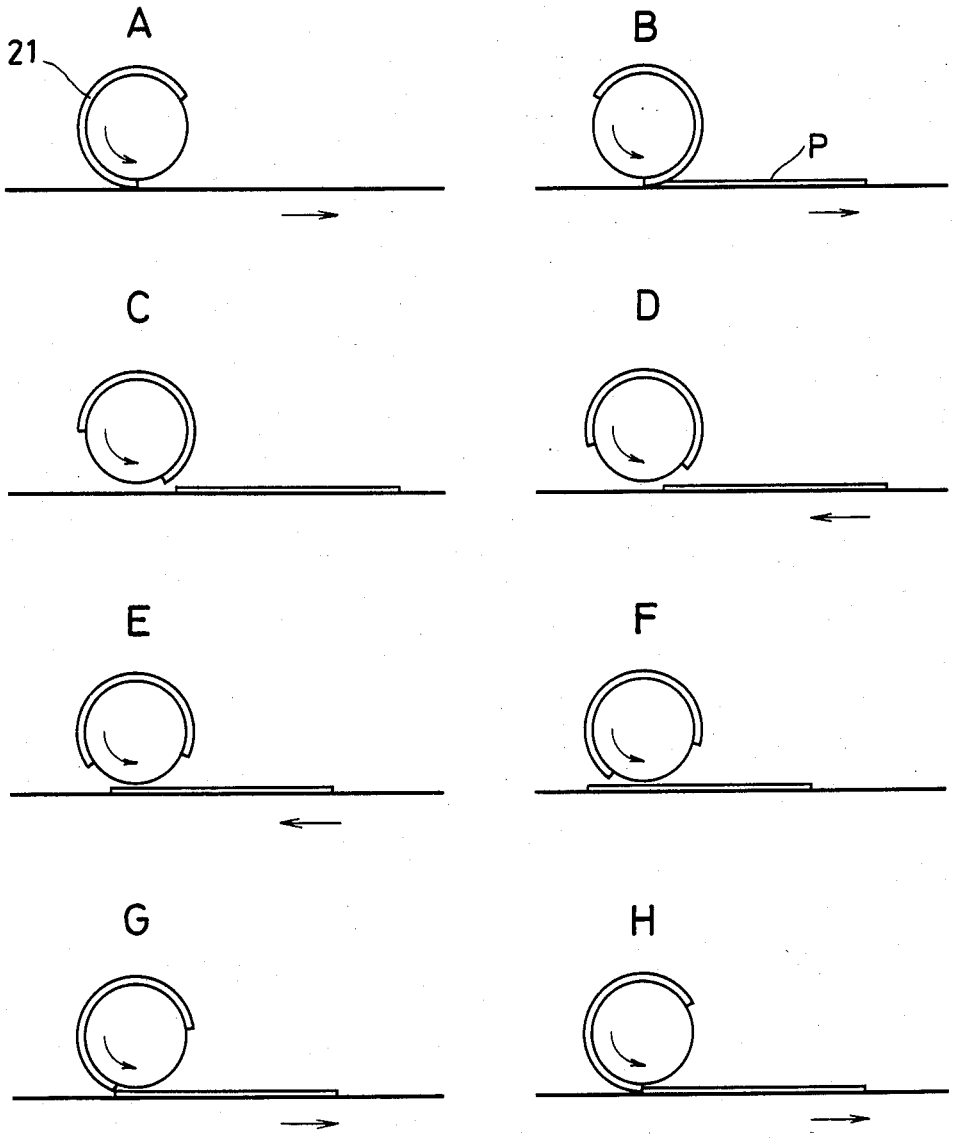
FIG. 7 is a schematic view showing how the relative position between the web and the plate cylinder changes during one cycle of printing.

This manner of control will be best understood from FIG. 7 on which letters A–H correspond to the points A–H on FIG. 6. Just before the printing is started, the plate 21 is at position shown at A. It will come at position shown at B at the end of printing. Letter P shows the printed portion. The web advances for a distance equal to the printing length. After printing, the plate cylinder keeps turning at a constant speed whereas the web is decelerated until its speed becomes zero at position shown at C. Then the web is backed and attains a constant speed at D and is decelerated from point E. It is then advanced from point F and accelerated until it again attains the same speed as the plate cylinder as shown at G. Now, the web will be printed with no blank space behind the last printed portion in correct register with the plate 21.

The first motor signal controls the control motor 29 so that in FIG. 6 the area of a triangle $BT_{12}C$ plus the area of a parallelogram $GFT_{21}H$ (representing the distance for which the web has moved forwardly after the print end point $T_{12}$) will be equal to the area of a parallelogram CDEF (representing the distance for which the web has moved backwardly after point $T_{12}$). As a result, at the next print start point $T_{21}$, the web will come back at the point where it was at the end of the last printing.

During the period from the print start point $T_{11}$ to the next print start point $T_{21}$, the plate cylinder 22 will make just one full turn. During the same period, the web is controlled to advance only for a distance which is equal to the printing length Lo, which is represented by the area of rectangle $AT_{11}T_{12}B$. For the next and subsequent printings, the control is done in the same manner as described above.

The abovesaid printing length may not be a single printing length in a continuous printing with no blank between the adjacent printed portions, but include any allowance for subsequent cutting, glueing or other processing as well as the actually printed portion.

Although a specific manner of control has been described, any other manner of control may be adopted for using a plate cylinder having a circumference greater than or equal to the maximum printing length.

What are claimed are:

1. A color printing machine for color printing a running web of paper comprising a plurality of printing units each having a plate cylinder and an impression cylinder, and a web length adjusting means provided between each pair of the adjacent printing units for adjusting the length of the web existing between each pair of the adjacent printing units so as to be equal to the printing length multiplied by an integer, further comprising:

a pair of feed rolls for feeding the web into the printing machine;

a pair of pull rolls for pulling the web out of the printing machine;

said plate cylinder adapted to carry a printing plate thereon and having a circumference which is greater than the length of the printing plate;

said impression cylinder adapted to press the web against the printing plate mounted on said plate cylinder;

a motor for driving said plate cylinders of the printing units;

a reversible motor for driving said feed rolls and said pull rolls to selectively advance and back the web;

a setting means for setting the circumference of said plate cylinder and the printing length and for generating a first signal proportional to the circumference of said plate cylinder and a second signal proportional to the printing length;

a signal generating means for generating a third signal proportional to the number of rotations of said motor for driving said plate cylinders;

a further signal generating means for generating a fourth signal proportional to the web speed; and a speed control means for receiving said first and second and third and fourth signals and for electrically controlling the speed of said reversible motor in response thereto so that the web will run at the same speed as the circumferential speed of the printing plates during the period from the start of one printing length to its end and so that the web speed integrated from the start of one printing to its end will be equal to one printing length and so that the web speed integrated from the end of one printing length to the start of the next printing length will be equal to zero, and so that the circumferential speed of the plate cylinder integrated from the start of one printing length to the start of the next printing length will be equal to the circumference of said plate cylinder.

* * * * *